United States Patent [19]

Saito

[11] Patent Number: 4,831,929

[45] Date of Patent: May 23, 1989

[54] SUCTION MEMBER FIXING APPARATUS FOR SHEET-FED PRINTING PRESS WITH TURN-OVER MECHANISM

[75] Inventor: Nobuaki Saito, Ibaraki, Japan

[73] Assignee: Komori Printing Machinery Co., Ltd., Tokyo, Japan

[21] Appl. No.: 109,234

[22] Filed: Oct. 16, 1987

[51] Int. Cl.[4] ..... B41F 5/02

[52] U.S. Cl. ..... 101/230

[58] Field of Search ..... 101/230, 183, 410, 409; 271/82, 277

[56] References Cited

U.S. PATENT DOCUMENTS 4,535,691 8/1985 Kida ..... 101/230

*Primary Examiner*—Clifford D. Crowder

*Attorney, Agent, or Firm*—Perman & Green

[57] ABSTRACT

In a suction member fixing apparatus for a sheet-fed printing press, two side plates are pivotally fitted on two end shafts of a double-diameter cylinder so that the surfaces of the side plates are in contact with end faces of the cylinder body. A fixing shaft having a head portion at one end and a threaded portion at the other end extends through central axial holes of the cylinder body and the two end shafts. Press rods radially extend through base portions of the two end shafts, are in contact with end faces of the side plates opposite to the cylinder body, and are moved upon threadable engagement of a screw member with the threaded portion to fix the side plates and the cylinder body by a surface pressure. Belleville springs are interposed between one press rod and the screw member to absorb extension of the fixing shaft due to an increase in temperature during printing.

6 Claims, 3 Drawing Sheets

SUCTION MEMBER FIXING APPARATUS FOR SHEET-FED PRINTING PRESS WITH TURN-OVER MECHANISM

BACKGROUND OF THE INVENTION

The present invention relates to a suction member fixing apparatus for fixing phase-adjustable suction members for drawing and holding a trailing edge of a sheet which is gripped by grippers of a double-diameter cylinder and conveyed thereby to a cylinder body after phase adjustment in a sheet-fed printing press with a turn-over mechanism.

Along with a variety of printing operations, various types of sheet-fed presses with a turn-over mechanism, which can selectively perform single side printing or double side printing, have been proposed and are commercially available. Printing machines of this type are mainly classified into a single-cylinder type printing press comprising a double-diameter cylinder as a turn-over cylinder, and a three-cylinder type printing press comprising a transfer cylinder, a turn-over cylinder, and a double-diameter cylinder arranged therebetween.

FIGS. 3 and 4 are views showing arrangements of cylinders for explaining the printing operation of the three-cylinder type sheet-fed printing press with a turn-over mechanism. FIG. 3 shows a case of a single-side printing mode, and FIG. 4 shows a case of a double-side printing mode. The arrangement and operation of the printing press of this type will be described with reference to FIGS. 3 and 4. A blanket cylinder 1 is arranged below a plate cylinder (not shown) to be in contact therewith. An impression cylinder 5 is arranged obliquely below the blanked cylinder 1 so that its circumferential surface is in contact with the cylinder 1. The impression cylinder 5 has gripper units 4 each consisting of a gripper 2 and a gripper pad 3 in a gap formed in an outer peripheral portion of the impression cylinder 5. In a printing unit at the downstream side, a blanket cylinder 6 contacting a plate cylinder (not shown), and an impression cylinder 10 which has gripper units 9 each consisting of a gripper 7 and a gripper pad 8 and a circumferential surface contacting the blanket cylinder 6 are also arranged. A turn-over mechanism consisting of three rollers, i.e., a transfer cylinder 11, a double-diameter cylinder 12, and a turn-over cylinder 13, the circumferential surfaces of which are in contact with each other, is arranged between the two impression cylinders 5 and 10. Of these cylinders, the transfer cylinder 11 comprises gripper units 16 each consisting of a gripper 14 and a gripper pad 15 in a gap formed in an outer peripheral portion of the transfer cylinder 11. The double-diameter cylinder 12 has a diameter twice that of the transfer cylinder 11 and the like. Two sets of gripper units 19 and 20 each consisting of a gripper 17 and a gripper pad 18 are arranged at positions of equal angular intervals of the outer peripheral portion of the cylinder 12. In addition, two suction heads 21 and 22 as suction members are arranged at positions advancing from the grippers 19 and 20 by a predetermined angle in a rotational direction of the cylinder. A plurality of suction heads 21 and 22 are arranged on the outer peripheral portion of the double-diameter cylinder 12 along the axial direction, so as to be movable i the circumferential direction, so that a phase with respect to the gripper units 19 and 20 in the circumferential direction can be adjusted. Gripper units (A) 25 each consisting of a gripper 23 and gripper pad 24, and gripper units (B) 28 each consisting of a gripper 26 and a gripper pad 27 are arranged in gaps formed in the outer peripheral portion of the turn-over cylinder 13 to be adjacent to each other in the circumferential direction. The cylinders 1, 5, 11, 12, 13, 10 and 6 are driven and coupled by gears. A stationary gear fixed to a shaft and a pivotal gear can be alternately fixed to one end shaft of the turn-over cylinder 13. The stationary gear is meshed with the gear of the impression cylinder 10. The pivotal gear is meshed with the gear of the double-diameter cylinder.

With the above arrangement, in the case of the single side printing shown in FIG. 3, when the cylinders are rotated in the directions indicated by arrows, a sheet 30 which is fed from a paper sheet feeder and is gripped by the gripper units 4 of the impression cylinder 5 through swing pre-gripper units, is then gripped and conveyed by the gripper units 16 of the transfer cylinder 11. When the sheet 30 passes between the blanket cylinder 1 and the impression cylinder 5, an image of the first color is printed thereon. The sheet 30 is then gripped and conveyed by the gripper units 19 (or 20) of the double-diameter cylinder 12 from the gripper units 16 of the transfer cylinder 11. When the gripper units 19 face the gripper units (A) 25, as shown in FIG. 3, the sheet 30 is then gripped and conveyed by the gripper units (A) 25. Thereafter, the sheet 30 is gripped and conveyed by the gripper units 9 of the impression cylinder 10. When the sheet 30 passes between the blanket cylinder 6 and the impression cylinder 10, an image of the second color is printed on the same surface on which the image of the first color has been printed.

When the single side printing mode is switched to the double side printing mode, the pivotal gear is pivoted from a state wherein the gripper units 19 and 25 face each other in FIG. 3, so as to obtain a state wherein the suction heads 21 face the gripper units (B) 28, as shown in FIG. 4. Thus, the phase of the upstream-side cylinder group including the double-diameter cylinder 12 is adjusted with respect to the turn-over cylinder 13, and the phase of the gripper units 18 and 20 relative to the suction heads 21 and 22 on the double-diameter cylinder 12 is adjusted, thereby coping with a change in sheet size. Since the positions at which the gripper units 19 and 20 of the double-diameter cylinder 12 release the sheet 30 are changed by a length of the sheet 30 in the single and double side printing modes, an actuating position of a sheet release cam is adjusted. When the cylinders are rotated after the switching adjustment is performed in this manner, the sheet 30 subjected to printing on a front surface in the same manner as in the single side printing mode is conveyed while being gripped by the gripper units 19 (or 20) of the double-diameter cylinder 12 and drawn by suction at its end by the suction heads 21 (or 22). The sheet 30 is conveyed until its trailing edge reaches the contacting point between the cylinders 12 and 13, as indicated by numeral 30A in FIG. 4. In this case, the trailing edge of the sheet 30A is gripped upon opening/closing of the gripper units (B) 28 and suction/release of the suction heads 21, and is released from the gripper units 20 at the same time. Then, the sheet 30A is conveyed by the turn-over cylinder 13 while forwarding the trailing edge side. During conveyance, both the gripper units (A) 25 and (B) 28 are instantaneously opened/closed at different timings, and the sheet 30A is gripped by the gripper units (A) 25 from the gripper units 21 on the cylinder 12 and is conveyed thereby. When the gripper units (A) 25 face the gripper unit 9 of the impression cylinder 10, the sheet 30A is gripped by the gripper units 9, and is conveyed, as indicated by 30B in FIG. 4. When the sheet 30B passes between the blanket cylinder 6 and the impression cylinder 10, since its rear surface contacts the blanket cylinder 6, the rear surface is subjected to printing. In this manner, the sheet is subjected to the double side printing, and is delivered.

In the three-cylinder type sheet-fed printing press with the turn-over mechanism operated as described above, the gripper units 19 and 20 for gripping the leading edge of a sheet and the suction heads 21 and 22 for drawing the trailing edge of the sheet by suction are provided to the double-diameter cylinder 12, as described above. The phase in the circumferential direction of these members must be adjusted when the printing mode is switched from the singe side printing mode to the double-side printing mode or when the sheet size is changed. For this reason, various suction member phase adjusting apparatuses have been proposed. For example, a plurality of grooves extending in the circumferential direction are formed on the circumferential surface of the cylinder body to be parallel to the axial direction. The suction heads supported on the side of the cylinder body are inserted in the corresponding grooves by any means, and are moved in the circumferential direction along the grooves, thereby adjusting the phase. Thereafter, the heads are fixed.

However, such a conventional apparatus employs the following structure. More specifically, two arms are fixed to two end axial portions of a double-diameter cylinder supported by two side frames, and a plurality of suction members are fixed to a shaft coupling the arms. During phase adjustment, bolts for fixing the arms to the cylinder end shafts are loosened to perform phase adjustment. Thereafter, the bolts are tightened to fix the arms. In this structure, since the arms must be arranged inside the two side frames, the two bolts must be loosened and tightened in the narrow space defined by the frames each time the phase adjustment is performed. Therefore, a considerable labor and time are required for adjustment.

SUMMARY OF THE INVENTION

It is an object of the present invention to provide a suction member fixing apparatus for a sheet-fed printing press with a turn-over mechanism, which can easily fix suction members after phase adjustment.

It is another object of the present invention to provide a suction member fixing apparatus which can maintain a fixing state between a cylinder body and side plates.

It is still another object of the present invention to provide a suction member fixing apparatus substantially free from an influence of heat during printing.

In order to achieve the above object, there is provided in a sheet-fed printing press with a turn-over mechanism comprising a double-diameter cylinder which includes a cylinder body having end shafts axially supported by two side frames, a pair of support members located inside the frames and respectively supported by the end shafts, and a plurality of suction members aligned on a shaft member axially extending through an outer peripheral hollow portion and supported between the two support members, a suction member fixing apparatus for the sheet-fed printing press with the turn-over mechanism, the two side support members being pivotally fitted on the two end shafts so that surfaces of the support members are in contact with end faces of the cylinder body, comprising a fixing shaft having a head portion at one end and a threaded portion at the other end and extending through central axial holes of the cylinder body and the two end shafts fixing members which radially extend through the base portions of the two end shafts, are in contact with end faces of the support members opposite to the cylinder body, and are moved upon threadable engagement of a screw member with the threaded portion to fix the support members and the cylinder body by a surface pressure and a spring member, interposed between the fixing member and the screw member, for absorbing extension of the shaft extending through the central axial holes due to an increase in temperature.

BRIEF DESCRIPTION OF THE DRAWINGS

FIGS. 1 and 2 show an embodiment of a suction member fixing apparatus for a sheet-fed printing press with a turn-over mechanism according to the present invention, in which FIG. 1 is a longitudinal sectional view of a double-diameter cylinder to which the present invention is applied, and FIG. 2 is a cross-sectional view taken along a line A—A in FIG. 1;

DETAILED DESCRIPTION OF THE PREFERRED EMBODIMENT

Figure 3:
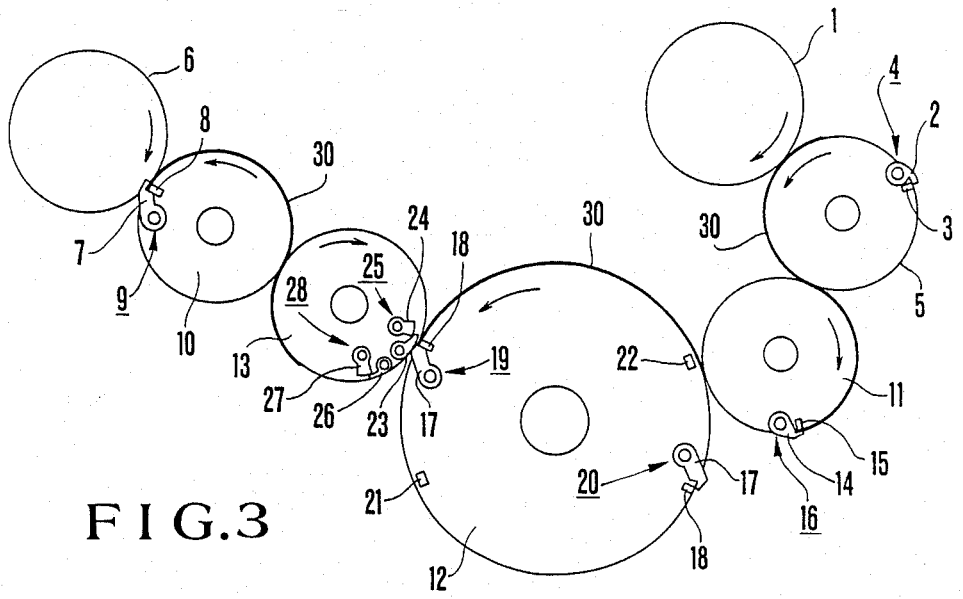
FIG. 3 is a view showing an arrangement of cylinders of the sheet-fed printing press with the turn-over mechanism for explaining a single side printing operation.
Figure 4:
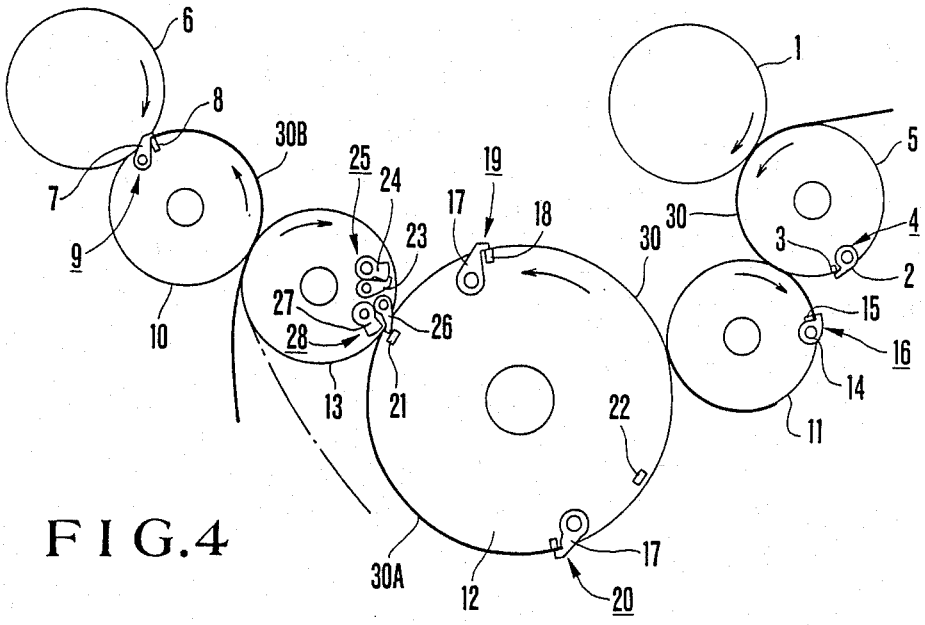
FIG. 4 is a view showing an arrangement of cylinders of the sheet-fed printing press with the turn-over mechanism for explaining a double side printing operation.

An embodiment of the present invention will be described hereinafter with reference to the accompanying drawings. Since the arrangement of cylinders and members of each cylinder have already been described with reference to FIGS. 3 and 4, a detailed description thereof will be omitted, and will be described with reference to the same drawings, if necessary.

Figure 1:
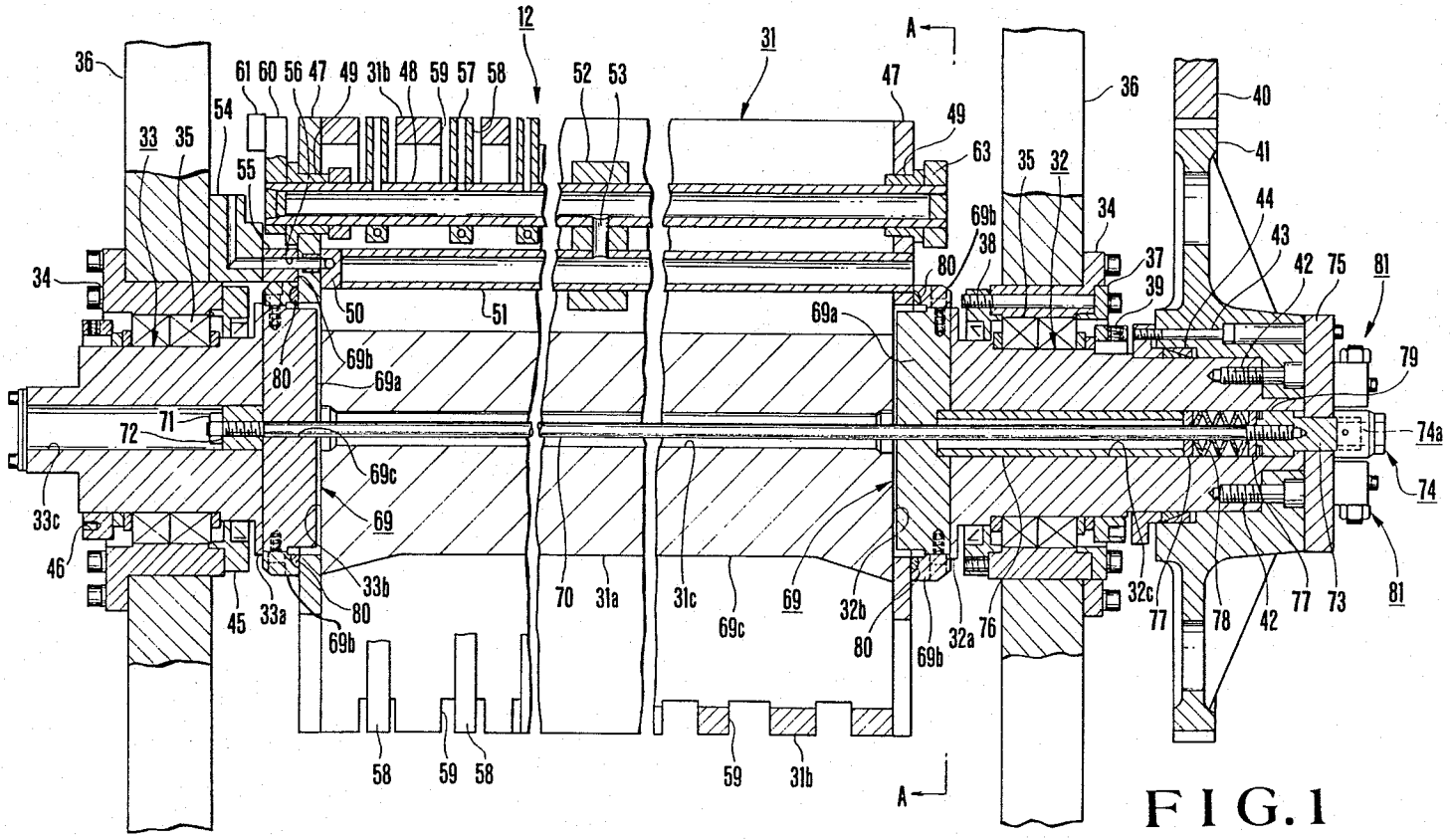
Figure 2:
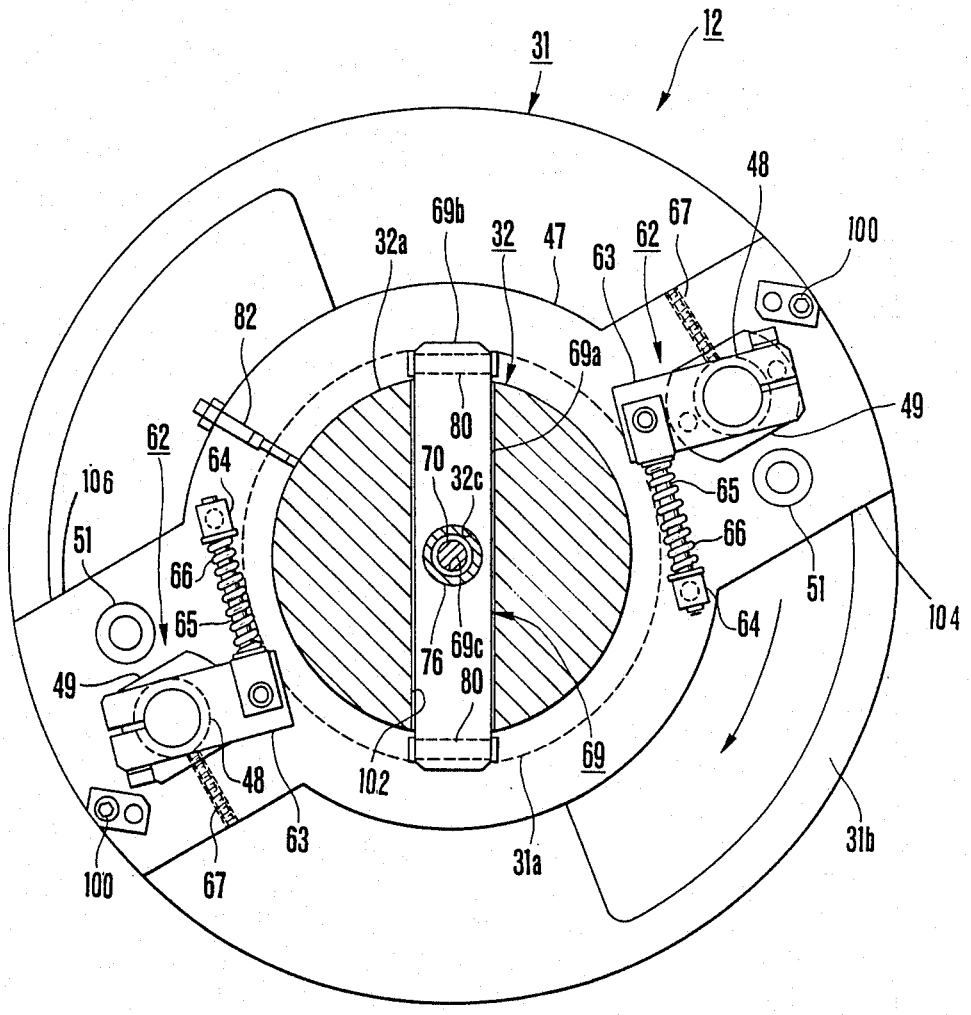

Referring to FIGS. 1 and 2, a double-diameter cylinder 12 comprises a columnar cylinder body 31 having a cast hollow portion, and end shafts 32 and 33 which are concentrically and integrally formed on the two end portions of the body 31. The end shafts 32 and 33 are pivotally supported by two side frames 36 through roll bearing 35 fitted in bearing cases 34. Reference numerals 37 and 38 denotes bearing holder members for holding the outer rings of the roll bearings 35; and 39, collars for pressing the inner rings. A double-diameter cylinder gear 41 meshed with a pivotal gear of the turn-over cylinder 13 is fixed to one end shaft 32 by a bolt 42. The gear 41 and the end shaft 32 are fixed by a friction coupling 44 contacting the shaft 32 by a bolt 43. A bearing holder member 45 and a collar 46 are also provided to the other end shaft 33. As described above, the pivotal gear 40 is fixed to the adjacent stationary gear on the side of the turn-over cylinder 13 to transmit a rotational force. The pivotal gear 40 is released from the stationary gear, so that the phase adjustment between the turn-over cylinder 13 and the double-diameter cylinder 12 can be performed.

Side plates 47 having a relatively disk-like shape with a relatively round open center section and, in the embodiment shown, two extending sections 104 and 106 extending outwardly towards the periphery of the cylinder 12 and having apertures passing therethrough for passage of portions of intake pipes 48 and base pipes 51. The side plates 47 are pivotally fitted on large-diameter portions 32*a* and 33*a* of the end shafts 32 and 33, respectively. Each side plate 47 is in contact with the end face defined by an axial portion 31*a* and an outer peripheral portion 31*b*, thereby restricting its inward movement. The pivotal side plates 47 are fixed to the cylinder body 31 by a fixing apparatus (to be described later). Air intake pipes 48 are axially supported through bearings 49 at positions of equal angular intervals of the outer peripheral portions of the two side plates 47 in the circumferential direction. Base pipes 51 are supported between end pipes 50 fitted in one side plate 47 to be adjacent to the end portions of the intake pipes 48, and the opposite side plate 47. Reference numeral 52 denotes a bracket, fixed to the base pipe 51 side, for coupling the base pipes 51 and the corresponding intake pipes 48 at their central portions. The brackets 52 pivotally support the corresponding intake pipes 48. Communication holes 53 for causing the base pipes 51 to communicate with the corresponding intake pipes 48 are formed in the brackets 52. Reference numeral 54 denotes a ring-shaped stationary valve fixed to one frame 36. The valve 54 is connected to a vacuum pump as a suction air source (not shown) via a hose. An arcuate rotary valve 55 is in sliding contact with the end face of the valve 54. An air path 56 is formed in the stationary valve 54, the rotary valve 55 and the end pipe 50 to cause the corresponding base pipe 51 to communicate with the vacuum pump. When the double-diameter cylinder 12 is rotated, air inside the intake pipes 48 is drawn by suction at a predetermined timing at which the air path on the side of the rotary valve 55 is in sliding contact with the arcuate air path on the side of the stationary valve 54 to communicate therewith. A plurality of suction heads 58 as suction members comprising suction ports 57 communicating with the intake pipe 48 are arranged along the axial direction and are fixed to the intake pipe 48. Each suction port 57 is open to tee circumferential surface of the cylinder body 31. The suction heads 58 are engaged in grooves 59 extending by a predetermined angle in the outer peripheral portion 31*b* of the cylinder body 31. When the side plates 47 are released from the cylinder body 31 and are pivoted, the phase between the gripper units 19 and 20 and the suction heads 58 in the circumferential direction can be adjusted. A cam follower 61 corresponding to the cam surface of a cam (not shown) on the side of the frame 36 is axially fitted on a roll lever 60 axially fitted on a projection of the intake pipe 48 on the side of the rotary valve 55. During one revolution of the double-diameter cylinder 12, when the cam follower 61 contacts the cam surface of the cam, the intake pipe 48 is pivoted through a predetermined angle through the roll lever 60. The suction heads 58 are moved inside the grooves 59 so that the trailing edge of the sheet drawn by the suction ports 57 is kept taut in the lengthwise direction. Reference numeral 62 denotes spring mechanisms for urging the cam followers 61 against the cam surfaces. Each spring mechanism 62 is constituted by a lever 63 which is fixed to the projection end on the side of the intake pipe 48 opposite the rotary valve 55 end of the intake pipe 48, a spring shaft 65 which is axially supported by a free end portion of the lever 63 and has the other end portion inserted in a post 64 on the side of the side plate 47, and a compression coil spring 66 wound around the spring shaft 65. Each spring mechanism 62 cooperates with the corresponding cam to pivot the corresponding suction head. Reference numeral 67 denotes grease nips for lubricating the pivotal movement of the intake pipe 48; and reference numeral 100 denotes pins used for driving a printing mode switching apparatus (not shown).

A suction member fixing apparatus for fixing the suction heads 58 on the side of the cylinder body 31 through the side plates 47 after the phase adjustment will be described below. More specifically, press rod holes 102 extend through the large-diameter portions 32*a* and 33*a* as the base portions of the end shafts 32 and 33 in the radial direction. Press rods 69 having a center section with a generally cylindrical shape or rod shape are inserted in the press rod holes 102. Each press rod 69 is constituted by a body 69*a* and a pair of press members 69*b* detachably fixed to the two end portions of the body 69*a* by bolts for the sake of assembly. An axial hole 69*c* is formed in the central portion of the body 69*a*. Axial holes 31*c*, 32*c*, 33*c* are respectively formed in the central portions of the axial portion 31*a* of the cylinder body 31 and the end shafts 32 and 33. A fixing shaft 70 extends through the axial holes 33*c*, 69*c*, 31*c*, 69*c*, and 32*c* which extend over the entire length of the cylinder. Movement of the fixing shaft 70 in one direction is restricted by a nut 71 engaged with one threaded end portion of the shaft 70 and a collar 72. A nut 74 having a square hole 74*a* is fixed to a screw member 73 threadably engaged with the other threaded portion. Axial movement of the nut 74 is restricted by a plate 75 fixed to the gear 41 by a bolt. A press pipe 76, a pair of washers 77, and a plurality of plate springs 78, and thrust bearings 79 are interposed between the screw member 73 and the corresponding press rod 69. With this structure, when a wrench is inserted in the square hole 74*a* of the nut 74 to tighten the nut 74, the fixing shaft 70 comes closer to the screw member 73. Thus, a surface pressure acts between the end faces of the press member 69*b* and the side plates 47, and the cylinder body 31, so that the side plates 47 and the cylinder body 31 are fixed by the surface pressure. In this embodiment, surface pressure adjusting members 80 having arcuate surfaces are interposed between the press surfaces of the press member 69*b* and each side plate 47. The adjusting members 80, in this embodiment, are generally able to absorb pressure exerted by press rods 69 and redistribute that pressure onto the side plates 47 in a uniform manner. Thus the adjusting members 80 act as a type of washer to uniformly distribute pressure and the arcuate surface of the adjusting members 80 cooperate with an arcuate receptacle on the press members 69*b* of the press rods to allow the rods to flex and pivot slightly at the adjusting members. However, any suitable means may be provided. When each press rod 69 is flexed by the surface pressure, this flexure is absorbed by the arcuate surface of the surface pressure adjusting members 80 so as to uniform the surface pressure. Reference numeral 81 denotes a click mechanism comprising a ball contacting a circumferential surface of the hexagonal head portion of the nut 74, and a spring member pressing this ball. Each time the nut 74 is pivoted through 60°, the mechanism 81 lightly locks the nut 74. Reference numeral 82 in FIG. 2 denotes a spring member which is used for phase adjustment between the gripper units 19 (or 20) and the suction heads 58 and lightly integrates the side plate 47 and cylinder body 31 to be rotated together.

The operation of the double-diameter cylinder apparatus with the above structure will be described. In the double-side printing operation described with reference to FIG. 4, when the trailing edge of the sheet 30 gripped by the gripper units 19 (or 20) of the double-diameter cylinder 12 is separated from the contacting point between the cylinders 11 and 12, the rotary valve 55 is in contact with the stationary valve 54, and air is drawn through the intake ports 57 of the suction heads via the air path 56, the base pipe 51, the communication hole 53, and the intake pipe 48. Therefore, the trailing edge of the sheet 30 is drawn by suction by the intake ports 57. When the cylinders are further rotated, the cam follower 61 is in contact with the cam surface, and causes the lever 60 to pivot against the biasing force of the compression coil spring 66. Thus, the intake pipe 48 is pivoted, and the suction heads 58 are moved inside the grooves 59, thereby extending the sheet 30. When the trailing edge of the sheet faces the gripper units (B) 28 of the turn-over cylinder 13, the gripper units (B) 28 grip the trailing edge of the sheet, and the rotary valve 55 is released from the stationary valve 54 to stop suction. Thus, since the trailing edge of the sheet is released from the suction by the suction heads 58, the sheet 30 is conveyed while being turned over. Since the remaining double side printing operation and the single side printing operation have been described with reference to FIGS. 3 and 4, a detailed description thereof will be omitted.

When the single and double side printing modes are switched and the sheet size is changed, a wrench is inserted in the square hole 74*a* of the nut 74 and the nut 74 is pivoted in a loosening direction. Then, the fixing shaft 70 is disengaged from the screw member 73 by the screw effect of the screw member 73. The surface pressure by the press members 69*b* is stopped, and engagement between the side plates 47 and the cylinder body 31 by the surface pressure can be released. The pivotal gear 40 is unlocked, and is pivoted through a gear device (not shown). Then, the gear 41 is pivoted to pivot the cylinder body 31. Although the side plate 47 is initially pivoted together with the body 31, when the suction heads 58 have reached predetermined positions for the single or double side printing mode, the side plates 47 are stopped by a device (not shown). Thereafter, since only the cylinder body 31 is pivoted, it can be stopped at a position corresponding to the sheet size. When the nut 74 is pivoted in the tightening direction, the fixing shaft 70 is screwed in the screw hole of the screw member 73 by the screw effect of the screw member 73. Then, the opposing press rod 69 is pulled, and the surface pressures by the two press members 69*b* act on the side plates 47 through the surface pressure adjusting members 80, thereby strongly fixing the side plates 47 and the cylinder body 31. In this case, in this embodiment, since the surface pressure adjusting members 80 are arranged, even when the surface pressure is too high and the press rods 69 are flexed, deformation of the press members 69*b* can be absorbed by the arcuated surfaces of the corresponding surface pressure adjusting members 80. Therefore, the press members 69*b* can be prevented from being deformed, and the surface pressure can always be constant. During operation, even if the fixing shaft 70 is extended due to an increase in temperature, since the Belleville springs 78 are provided, the extension can be absorbed thereby, and engagement between the side plates 47 and the cylinder body 31 cannot be loosened.

As can be seen from the above description, according to the present invention, in a sheet-fed printing press of with a turn-over mechanism, two side support members for supporting the two end portions of a shaft member on which suction members are mounted are pivotally fitted on the two end shafts of the double-diameter cylinder so that their surfaces are in contact with the end faces of the cylinder body. A fixing shaft having a head portion and a threaded portion at two ends is provided to extend through the central axial holes of the cylinder body and the two end shafts. In addition, fixing members extend through the base portions of the two end portions in the radial direction to be in contact with the end faces of the support members opposite to the cylinder body. The fixing members are moved upon threadable engagement of the screw member with the threaded portion of the fixing shaft, so as to fix the support members and the cylinder body by the surface pressure. Therefore, since the support members for the suction members can be fixed to the cylinder body only by pivoting the screw member outside one frame having an open surrounding portion, operability is greatly improved as compared to a conventional cylinder wherein a fixing operation is performed at two portions inside the frames. Thus, a labor can be reduced and an operating time can be shortened. During the printing operation, the fixing shaft is extended due to an increase in temperature. However, since this extension is absorbed by spring members, the surface pressure cannot be changed, and engagement between the support members and the cylinder body cannot be loosened.

What is claimed is:

1. In a sheet-fed printing press with a turn-over mechanism comprising a double-cylinder which includes a cylinder body having end shafts axially supported by two side frames, a pair of support members located inside said frames and respectively supported by said end shafts, and a plurality of suction members aligned on a shaft member axially extending through an outer peripheral hollow portion and supported between said two support members, a suction member fixing apparatus for said sheet-fed printing press with the turn-over mechanism, said two side support members being pivotally fitted on said two end shafts so that surfaces of said support members are in contact with end faces of said cylinder body, comprising:

a fixing shaft having a head portion at one end and a threaded portion at the other end and extending through central axial holes of said cylinder body and said two end shafts;

fixing members which radially extend through the base portions of said two ends shafts, are in contact with end faces of said support members opposite to said cylinder body, and are moved upon threadable engagement of a screw member with said threaded portion to fix said support members and said cylinder body by a surface pressure; and a spring member, interposed between said fixing member and said screw member for absorbing extension of said shaft extending through the central axial holes due to an increase in temperature.

2. An apparatus according to claim 1, further comprising a nut threadably engaged with said screw member to tighten or loosen said fixing shaft, thereby tightening or loosening said support members from said cylinder body through said fixing members.

3. An apparatus according to claim 1, wherein said head portion of said fixing shaft comprises a nut engaged with a threaded portion of said fixing shaft and a collar integrally formed with said nut.

4. An apparatus according to claim 1, wherein each of said fixing members comprises a press rod having a center section with a central hole adapted to receive said fixing shaft, and a pair of press members fixed to both ends of said center section.

5. An apparatus according to claim 4, further comprising surface pressure adjusting members disposed between said press members and side plates adjacent said cylinder body and each adjusting member having an arcuate surface, said surface pressure adjusting members being adapted to absorb flexure of said press rods upon fixing of said side plates to said cylinder body.

6. An apparatus according to claim 1, wherein said spring member comprises a plurality of Belleville springs.

* * * * *